United States Patent [19]

Stephens

[11] 4,055,334

[45] Oct. 25, 1977

[54] RECYCLE BURNER SYSTEM

[75] Inventor: Wilbur E. Stephens, Redwood City, Calif.

[73] Assignee: Alumax Inc., San Mateo, Calif.

[21] Appl. No.: 656,265

[22] Filed: Feb. 9, 1976

[51] Int. Cl.[2] ..... F27B 3/22

[52] U.S. Cl. ..... 266/138; 266/156; 266/200; 266/901

[58] Field of Search ..... 75/65 R, 68 R; 110/18 R, 18 C; 266/138, 144, 156, 200, 214, 900, 901

[56] References Cited

U.S. PATENT DOCUMENTS

| | | | |
|---|---|---|---|
| 2,092,145 | 9/1937 | Wanner | 266/214 |
| 2,264,740 | 12/1941 | Brown | 75/65 R |
| 3,933,343 | 1/1976 | Rawlings | 266/901 |

*Primary Examiner*—Gerald A. Dost

*Attorney, Agent, or Firm*—Limbach, Limbach & Sutton

[57] ABSTRACT

A reverberatory furnace which has an external passage for recycling hot exhaust gases from the furnace chamber back to the main burner port, means for introducing additional air or oxygen into the recycling passage, and a main burner which supplies fuel plus up to 50 percent of the air or oxygen required for total combustion into the furnace chamber so that the air or oxygen added to the recycling passage is thereby preheated by the exhaust gases and mixes with the fuel-rich mixture from the burner to provide complete combustion of the exhaust gases while simultaneously reducing the cost of the fuel requirement because of the preheating effect of the exhaust gases on the additional supply of air or oxygen.

4 Claims, 1 Drawing Figure

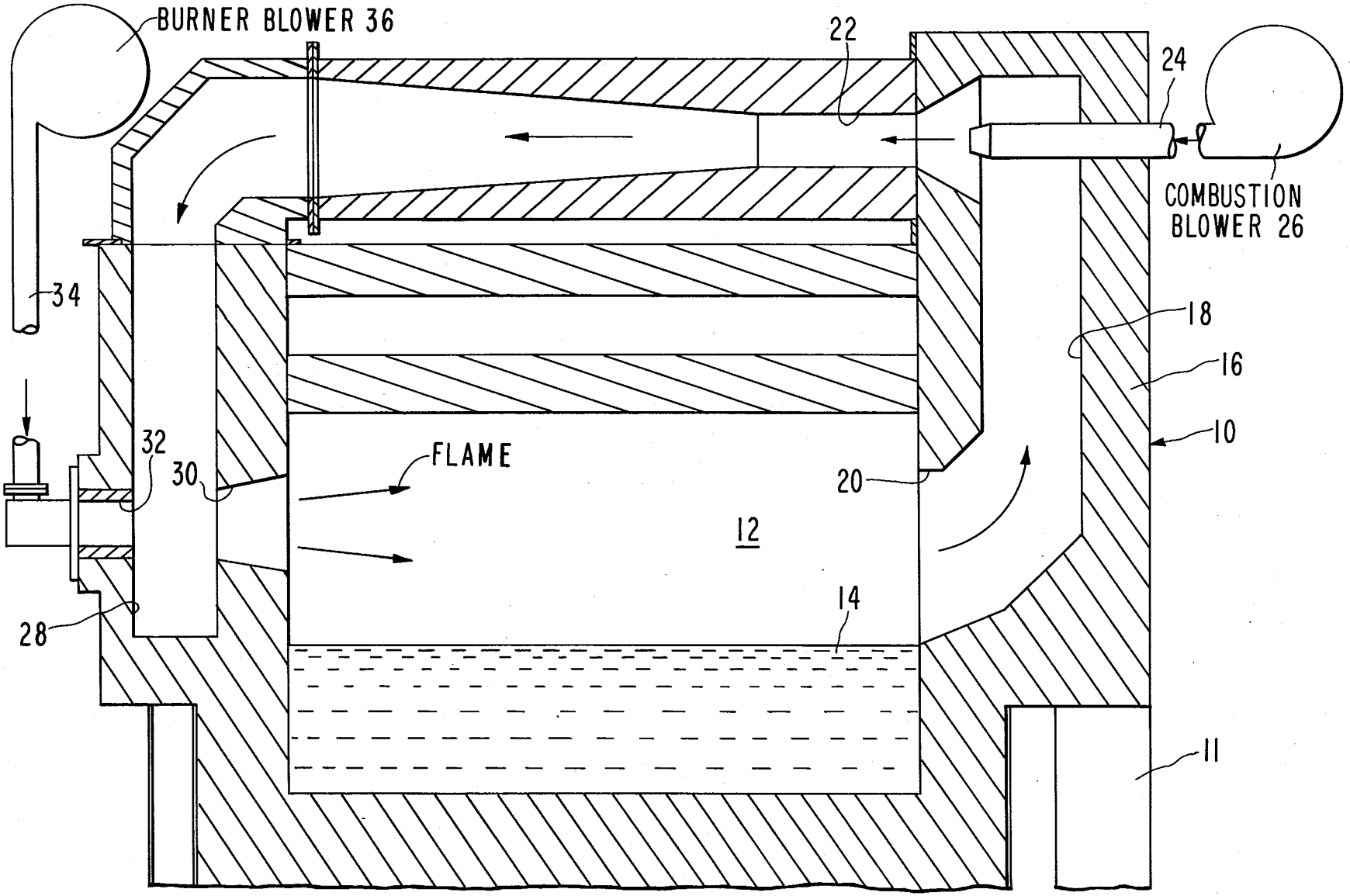
COMBUSTION BLOWER 26
24
18
16
10
11
22
20
14
12
FLAME
BURNER BLOWER 36
30
32
34
28

RECYCLE BURNER SYSTEM

BACKGROUND OF THE INVENTION

The present invention relates to a furnace for melting metal and more particularly to an improved reverberatory furnace for melting aluminum.

The normal reverberatory furnace includes a closed furnace chamber in which a molten metal bath is contained and a burner which directly fires over the surface of the molten metal bath. The furnace atmosphere, i.e. the exhaust gases and uncombusted waste products, are contained within the furnace chamber until they exit through the exhaust stack. Such exhaust gases are normally exhausted at a temperature range between 1200° to 2200° F.

It is of primary importance in good furnace design to have sufficient heat absorbing area for efficient thermal energy transfer. The burners must be properly sized and located for flame distribution and gas flow. In order to have sufficient heat absorbing area, however, the furnace must be dimensioned so that there is a sufficient area for the flame path to pass over the molten surface. This may require that the furnace be unnecessarily large for the amount of molten metal to be contained.

Still another problem is that because some of the exhaust gases from charge contaminents are not fully combusted, they must be either passed through special filtering mechanisms or must be further combusted requiring the addition of extra fuel in the exhaust system. This is economically inefficient and wasteful of natural fuel resources.

SUMMARY OF THE INVENTION

The above and other disadvantages of prior art furnaces are overcome by the present invention of an improved furnace of the type having a closed furnace chamber for containing a bath of molten metal, the furnace chamber having a main burner port, and burner means for admitting fuel and air or oxygen to the interior of the chamber through the main burner port. The improvement of the invention comprises a passage external to the furnace chamber for recycling exhaust gases from the furnace chamber back to the burner port. Eductor means are provided for introducing additional air or oxygen into the recycling passage. The burner means is so constructed that it introduces fuel into the furnace chamber along with only a portion of the oxygen requirement for total combustion of the fuel. In this way, the oxygen added into the recycling passage by the eductor means is preheated by mixing with the furnace chamber exhaust gases and then combines with the oxygen introduced by the burner means so that complete combustion can eventually take place in the furnace chamber. The recycling passage circulates the gases over the charge or heat absorbing area two to three times before the gases are finally exhausted to the air. The oxygen added to the recycling passage is heated by the exhaust gases to about 1500° F. This is equivalent to a recuperator heating all of the air to approximately 800° F at considerably less investment cost. This system has also proven particularly effective as an incinerator since it thoroughly mixes the contaminants from the furnace chamber and combusts them along with the fuel in the system. Using the system for direct emission control shows a much greater savings over a furnace with a separate after burner since all the heat is directly applied to the furnace chamber.

In one preferred embodiment of the invention, the recycling passage includes a venturi portion which is located between the main burner port and the eductor means for causing turbulent mixing of the additionally introduced oxygen from the eductor means and the exhaust gases from the furnace chamber. The furnace chamber includes a secondary burner port and one end of the recycling passage is in communication with and interposed between the main burner port and the secondary burner port. In this way, fuel and oxygen from the burner means are mixed with the recycled exhaust gases plus the additional oxygen from the eductor means and are then introduced into the furnace chamber through the secondary burner port so that all of the fuel is ultimately consumed.

It is therefore an object of the present invention to provide an improved reverberatory furnace which does not require recuperative heating of the fuel being introduced into the furnace chamber;

It is another object of the invention to provide an improved furnace in which the exhaust gases are fully burned before being exhausted from the furnace;

It is a still further object of the invention to provide a reverberatory furnace having improved heat transfer characteristics by maximizing the area available for heat absorption from the burner flame by the molten metal contained in the furnace.

The foregoing and other objectives, features and advantages of the invention will be more readily understood upon consideration of the following detailed description of certain preferred embodiments of the invention, taken in conjunction with the accompanying drawings.

BRIEF DESCRIPTION OF THE DRAWING

FIG. 1 is a vertical, sectional view of a preferred embodiment of the invention.

DETAILED DESCRIPTION OF THE PREFERRED EMBODIMENT

Referring now more particularly to the drawing, there is shown a reverberatory furnace 10. The furnace 10 is made of a refractory material supported by a steel frame 11. The furnace encloses a furnace chamber 12 which contains a bath 14 of molten metal.

The furnace 10 includes an outer, surrounding wall 16 which contains a hollow, recycling passage 18. The passage 18 as viewed in FIG. 1 includes an outlet port 20 which communicates with the furnace chamber 12 above the level of the molten bath 14. The passage 18 is then directed upwardly, as viewed in the figure, where it makes a 90° turn to the left as viewed in the figure above the furnace chamber. At the point where the recycling passage 18 makes the 90° turn above the furnace chamber 12, the diameter of the passage narrows to form a venturi section 22. At this same point an eductor nozzle 24 penetrates through the wall 16 and is directed down the axial length of the venturi section 22. The eductor nozzle 24 is connected to a combustion blower 26. The combustion blower 26 forces air through the eductor nozzle 24 and it is jetted downstream through the venturi portion 22 of the recycling passage 18. The amount of air added by the combustion blower 26 through the eductor nozzle 24 is approximately half that required to burn the fuel introduced into the enclosed furnace chamber 12.

The recycling passage 18 after passing over the roof of the furnace chamber 12 descends through the wall opposite the outlet port 20. The passage then ends in a stub portion 28. This stub portion communicates with the interior of the furnace chamber 12 through a secondary burner port 30 which is cone shaped with the taper of the cone narrowing towards the exterior of the chamber 12. The stub portion 28 also communicates with a main burner port 32 in the exterior wall of the furnace 10. The main burner port 32 is connected by means of a pipe 34 to a burner blower 36. The burner blower 36 forces fuel plus approximately half the amount of air required to totally combust that fuel through the pipe and out of the main burner port 32. In passing through the stub portion 28, this fuel and air mixture combines with the hot exhaust gases and added air from the eductor nozzle 24 and is thereafter forced out through the secondary burner port 30 into the furnace chamber. The air added by the eductor nozzle 24 having been mixed with the hot exhaust gases is preheated to approximately 1500° F. It passes some of this heat to the air and fuel mixture exiting from the main burner port 32 to heat this mixture and together the combined mixture has a temperature of approximately 700° to 800° F in exiting from the secondary burner port 30. This eliminates the need for a recuperator. The exhaust gases are eventually exhausted to the air by a conventional exhaust stack (not shown).

Still another advantage is that charge contaminants are pulled from the furnace chamber through the recycling passage 18 and the secondary burner port 30 and are consumed as furnace fuel rather than requiring an after burner chamber which would necessitate added fuel for incineration. Throughout this application, whenever the term oxygen has been used, it is to be understood as including air which contains oxygen. In some cases, however, for example with heavily contaminated charges, oxygen alone or an oxygen rich mixture of air can be added to enhance the incineration capabilities.

The effect of the recycling system also is to lengthen the flame path in order to more efficiently dissipate the heat into the furnace. It has been calculated that the eductor and recycling systems circulate the hot gases over the charge or heat absorbing area two to three times before exhausting them. For heat transference, this is the equivalent of lengthening the flame path.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. An improved furnace of the type having a closed furnace chamber for containing a bath of molten metal, the furnace chamber having a main burner port, and burner means for establishing a flame path over the bath of molten metal by admitting fuel and oxygen to the interior of the chamber through the main burner port wherein the improvement comprises burner means which introduces both fuel and only a portion of the oxygen requirement for total combustion of the fuel, a passage external to the furnace chamber for recycling exhaust gases from the furnace chamber back to the main burner port, and eductor means for introducing the additional oxygen necessary for complete combustion into the recycling passage under pressure and in a direction to propel the exhaust gases in the recycling passage towards the main burner port, whereby the oxygen added into the recycling passage by the eductor means is preheated by mixing with the furnace chamber exhaust gases and the flame path is lengthened.

2. An improved furnace as recited in claim 1 wherein the burner means introduces fuel together with only 50% or more of the oxygen required for total combustion into the furnace chamber through the main burner port and the eductor means introduces the remainder of the required oxygen into the recycling passage.

3. An improved furnace as recited in claim 1 wherein the furnace includes a secondary burner port and one end of the recycling passage is in communication with and interposed between the main burner port and the secondary burner port such that fuel and oxygen from the burner means are mixed with the recycled exhaust gases plus additional oxygen from the eductor means and are then introduced into the furnace chamber through the secondary burner port.

4. An improved furnace of the type having a closed furnace chamber for containing a bath of molten metal, the furnace chamber having a main burner port, and burner means for admitting fuel and oxygen to the interior of the chamber through the main burner port wherein the improvement comprises a recycling passage external to the furnace chamber for recycling exhaust gases from the furnace chamber back to the main burner port, eductor means for introducing additional oxygen into the recycling passage, and wherein the recycling passage includes a venturi portion located between the main burner port and the eductor means for causing turbulent mixing of the additionally introduced oxygen from the eductor means and the exhaust gases from the furnace chamber, and further wherein the burner means introduces fuel along with only a portion of the oxygen requirement for total combustion of the fuel whereby the oxygen added into the recycling passage is preheated by mixing with the furnace chamber exhaust gases.

* * * * *